US006287173B1

(12) United States Patent
Crevasse et al.

(10) Patent No.: US 6,287,173 B1
(45) Date of Patent: Sep. 11, 2001

(54) LONGER LIFETIME WARM-UP WAFERS FOR POLISHING SYSTEMS

(75) Inventors: Annette Margaret Crevasse, Apopka; William Graham Easter, Orlando; Alvaro Maury, Orlando; John Albert Maze, Orlando; Frank Miceli, Orlando, all of FL (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/481,236

(22) Filed: Jan. 11, 2000

(51) Int. Cl.[7] ..... B24B 53/007
(52) U.S. Cl. ..... 451/41; 451/56; 451/444
(58) Field of Search ..... 451/41, 56, 287–289, 451/290, 291, 443, 444, 21, 72

(56) References Cited

U.S. PATENT DOCUMENTS 4,450,652 * 5/1984 Walsh ..... 451/288 X
4,873,792 * 10/1989 Linke et al. ..... 451/288 X
4,918,869 * 4/1990 Kitta ..... 451/288
5,191,738 * 3/1993 Nakazato et al. ..... 451/288 X
5,860,853 * 1/1999 Hasegawa et al. ..... 451/41 X
5,890,951 * 4/1999 Vu ..... 451/56
5,924,916 * 7/2000 Yamashita ..... 451/41 X
6,059,636 * 5/2000 Inaba et al. ..... 451/41 X

* cited by examiner

*Primary Examiner*—Joseph J. Hail, III
*Assistant Examiner*—Anthony Ojini
(74) *Attorney, Agent, or Firm*—Christie, Parker & Hale, LLP

(57) ABSTRACT

A method for preparing a chemical mechanical polishing apparatus for polishing product substrates includes polishing designated "warm-up" substrates until polishing pad characteristics have achieved steady state conditions. The reusable warm-up substrates may be formed of a mechanically resistant material or a material having substantially the same removal characteristic as the product film to be polished. The reusable warm-up substrates may also be formed of a mechanically resistant film formed over a semiconductor substrate. The polishing pad characteristic of pad compression may be determined using a previously established correlation or it may be measured.

21 Claims, 2 Drawing Sheets

LONGER LIFETIME WARM-UP WAFERS FOR POLISHING SYSTEMS

FIELD OF THE INVENTION

The present invention relates most generally to the semiconductor manufacturing industry and more particularly to preparing a chemical mechanical polishing apparatus for production use.

BACKGROUND OF THE INVENTION

Chemical mechanical polishing (CMP) operations are widely used in the semiconductor manufacturing industry for polishing film structures during the fabrication of semiconductor devices. A chemical mechanical polishing operation is generally used for several operations during the fabrication of each semiconductor device. Consumable costs associated with CMP operations represent an ever-increasing portion of total production costs associated with the semiconductor manufacturing industry. The "warm-up" wafers used in conjunction with CMP operations are an example of such a consumable item. The warm-up wafer is generally a silicon wafer coated with a blanket, or non-patterned film of a dielectric, metal or other film which is substantially identical to the production film to be polished, both in composition and dimension. A silicon wafer is a common example of a substrate used in the semiconductor manufacturing industry.

CMP operations may be carried out using various CMP apparatuses. After various events have occurred, the CMP apparatus must go through a warm-up procedure to qualify the apparatus for polishing product wafers. By product wafers it is meant the wafers on which actual semiconductor devices, such as integrated circuits, are being formed. Examples of events which require the CMP apparatus to undergo the warm-up procedure include various maintenance procedures, consumable changes such as a new polishing pad being installed, and the apparatus being powered down or left to sit idle for a significant period of time.

The "warm-up" procedure may include alternating polishing and conditioning operations until the pad surface is sufficiently conditioned and the polishing pad characteristics have achieved steady state conditions. Once the polishing pad characteristics have achieved steady state conditions, the polishing process will be a generally repeatable and reliable process with consistent polishing qualities. For example, the removal rate for a given film will be consistent once steady state polishing conditions are achieved. Examples of polishing pad characteristics which may achieve steady state conditions as a result of the warm-up procedure include the temperature at the polishing pad surface, the degree of pad pore saturation with polishing slurry, the chemical boundary layer thickness formed on the polishing pad surface, the water absorptive qualities of the pad, and, in some cases, the contour formed on the pad surface. An especially important pad characteristic which achieves steady state condition after a sufficient warm-up polishing time is the degree of pad compression.

The warm-up polishing operation involves polishing a warm-up wafer in each polishing head or carrier. A typical CMP apparatus may include 1–5 polishing heads or carriers. The polishing pad is compressed due to the polishing of the warm-up wafers using process conditions which are generally similar to the polishing conditions of the production polishing operation which will be carried out on product substrates after the warm-up procedure is completed. In addition, some polishing heads or carriers include a carrier film which is also compressed to a steady state condition during the warm-up polishing procedure. Generally speaking, a conventional warm-up polishing procedure involves each polishing head polishing 2–3 warm-up wafers to ready the polishing apparatus for production use. Each warm-up polishing operation may remove 0.3 to 0.6 microns of consumable material from the surface of the warm-up wafer. The warm up polishing procedure is carried out until polishing pad characteristics have achieved steady state conditions, including the desired degree of pad compression being achieved. The degree of pad compression may be measured using various techniques. It is important that steady state levels of polishing pad characteristics such as pad compression, are achieved. This ensures that polishing qualities, such as film removal rate, will remain constant to ensure a repeatable polishing process.

Wafers conventionally used as warm-up wafers include silicon wafers which have been coated with a blanket film formed of the same material which is to be polished on product wafers. According to a conventional method, the thickness of this blanket film may be on the order of 1.5 microns. Warm-up wafers may be used only 2 or 3 times since it is undesirable to expose a different, underlying material while performing the warm-up polishing operation. Once the underlying silicon is exposed during polishing and subsequently polished, the warm-up wafer is unsuitable for use in evaluating film removal rates and must be scrapped. The transition from polishing one film to another during a continuous polishing operation also changes the friction at the polishing surface and can disrupt system settings. For example, different polished species and chemistries are introduced to the polishing pad surface. Since polishing tools include multiple polishing heads, this results in thousands of warm-up wafers being consumed each year to support CMP operations. This is true even though warm-up wafers which have not had the underlying silicon exposed during polishing, as above, can be reused by "reworking".

By reworking, it is meant that the residual blanket film which was not completely removed during the warm-up polishing operation, is completely stripped from the warm-up wafer using a stripping operation. The warm-up wafer is then cleaned using a further operation. The cleaned warm-up wafer is then coated again, with the material which will be polished during the warm-up procedure. The reworking procedure is a costly and time-consuming process. Each processing operation requires the use of dedicated equipment which could otherwise be used to process product wafers. Each operation also requires raw materials and production operator time. The reworking process may only be repeated a limited number of times because, once the underlying substrate of the warm-up wafer is attacked appreciably, the wafer may no longer be used as a warm-up wafer. In some cases, the reworking procedure creates pits and produces stresses upon the backsides of the wafers. This can cause the wafer to break during a subsequent polishing operation, which results in considerable equipment down time and costly consumable changes. These pits and stresses are difficult to detect, making the reworking procedure a risky undertaking.

As such, it can be seen that there is a need in the art to provide for durable warm-up wafers which are not quickly consumed and which effectively prepare the CMP apparatus for production use by compressing the polishing pad to the desired level of compression and producing steady state pad polishing characteristics which, in turn, produce a repeatable and reliable polishing process.

SUMMARY OF THE INVENTION

The present invention provides warm-up wafers to be used in conjunction with a chemical mechanical polishing operation, and a method which utilizes the warm-up wafers to prepare a CMP apparatus for polishing product wafers. The warm-up wafers may be formed of a material which is either mechanically resistant, or which has similar or identical removal characteristics as the film to be polished on the product wafer. In another exemplary embodiment, the warm-up wafers may include a mechanically resistant material which is formed over a semiconductor substrate. Warm-up wafers are polished using a warm-up polishing operation which is similar to the production polishing operation to be performed subsequently. The warm-up procedure is carried out until polishing pad characteristics such as the degree of pad compression have achieved steady state conditions and the apparatus is production-worthy. Pad compression may be measured or otherwise ascertained using various techniques. After polishing pad characteristics such as pad compression have achieved steady state or prescribed levels, the chemical mechanical polishing apparatus may be used for polishing product wafers.

DETAILED DESCRIPTION OF THE INVENTION

The present invention provides warm-up substrates to be used in conjunction with a chemical mechanical polishing operation, and a method which utilizes the warm-up substrates to prepare a CMP apparatus for polishing product substrates. Product substrates are simply substrates upon which product semiconductor devices such as integrated circuit devices, are being formed. In the semiconductor manufacturing industry, substrates are alternatively referred to as wafers. Product substrates are typically formed of silicon, and are known as silicon wafers. Hereinafter, substrates will be referred to as wafers.

Figure 1:
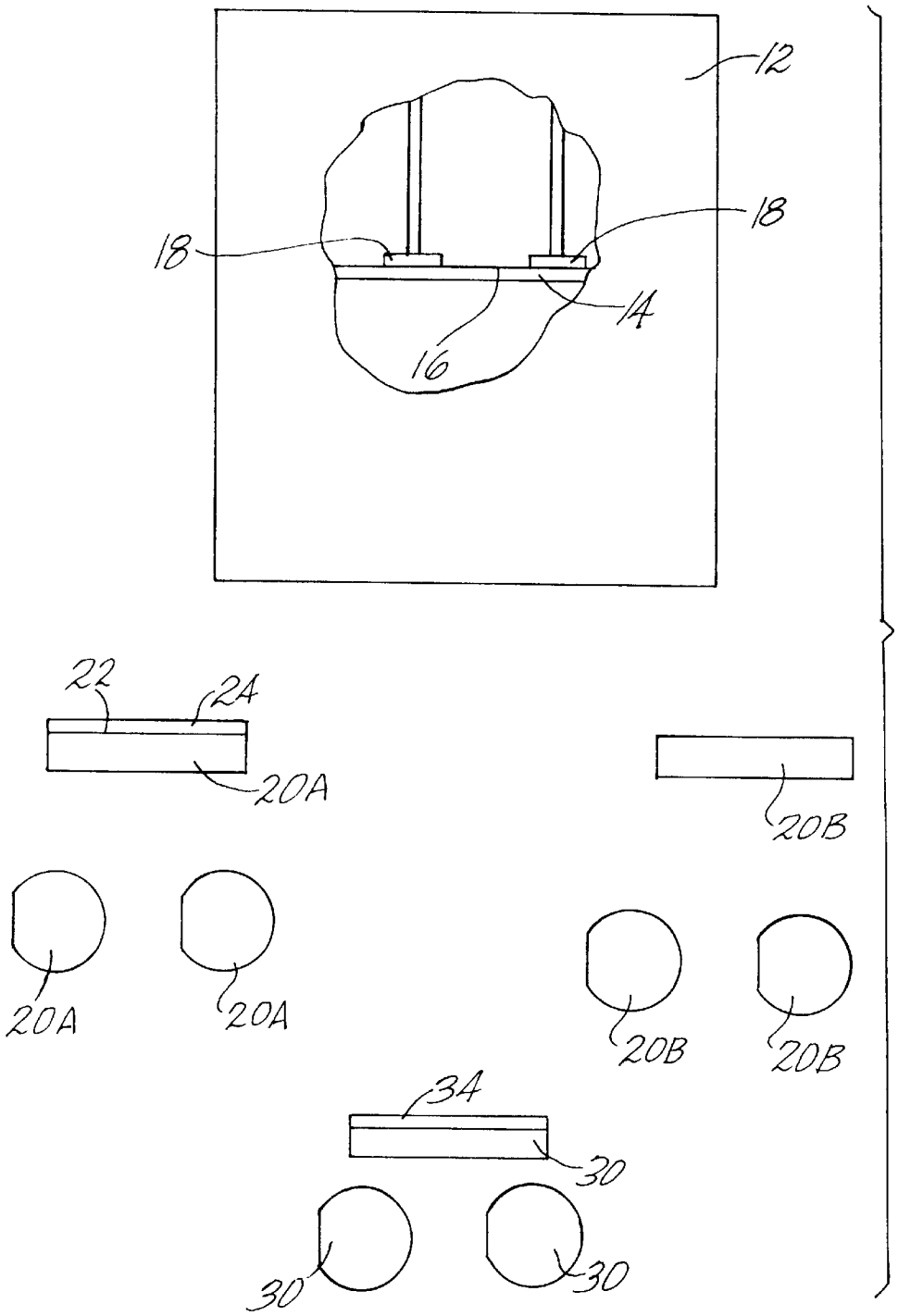
FIG. 1 is a plan view showing exemplary warm-up wafers and product wafers and a partial cut-away side view of an exemplary CMP apparatus.

Various CMP apparatuses are available for polishing wafers having various dimensions. In the semiconductor manufacturing industry, generally circular wafers having diameters ranging from 3 to 12 inches are common. The warm-up wafers and method of the present invention may be used in conjunction with any suitable CMP apparatus. It should be understood that the warm-up wafers are of the same dimension as product wafers, as they will be polished in the same CMP apparatus which is generally adapted to polish wafers of a fixed dimension. Referring now to FIG. 1, exemplary warm-up wafers 20A and 20B are shown in both plan views and side views. Product wafers 30 shown in both plan view and side view, are of the same dimension and include product film 34.

First Exemplary Embodiment of Warm-Up Wafers

According to one exemplary embodiment, the warm-up wafers of the present invention may be formed of silicon material similar to product wafers, and may have a mechanically resistant film formed over the wafer surface. FIG. 1 shows a side view of the first exemplary embodiment of warm-up wafer 20A, which includes mechanically resistant film 24 formed over wafer surface 22 of warm-up wafer 20A. Examples of mechanically resistant films 24 include silicon carbide (SiC), glass, quartz and other materials which are resistant to being removed by polishing. The mechanically resistant materials may be formed over the silicon surface using conventional methods.

Prior to committing product wafers to a CMP apparatus, then, a requisite level of pad compression must be first attained. More generally, prior to committing product wafers to a CMP apparatus, steady state conditions must be attained for the various polishing pad characteristics. This is done by polishing warm-up wafers according to the method of the present invention. According to a first exemplary embodiment of a warm-up procedure, the warm-up procedure may include alternating a series of polishing and conditioning operations to ensure that the pad surface is also conditioned sufficiently.

The present invention includes providing a group of warm-up wafers according to the first, second, or third embodiments of warm-up wafers described above. In each case, each warm-up wafer must conform to the product wafer size both in lateral dimensions and in thickness since a typical CMP apparatus operates using a tight set of wafer thickness tolerances. In each case the warm-up polishing procedure will be carried out by positioning a warm-up wafer within each polishing head of the CMP apparatus, and polishing the set of positioned warm-up wafers simultaneously. A typical CMP apparatus includes 1–5 polishing heads.

A typical "original" thickness for an unused wafer may be on the order of 700 to 725 microns. In an exemplary embodiment, the product wafer formed of silicon may be approximately 725 microns and the CMP apparatus may be configured to accommodate this target thickness of 725 microns. A typical CMP apparatus set up for polishing a wafer having a target thickness of 725 microns may be capable of polishing a wafer having a thickness ranging from 650–750 microns, most preferably within the range of 735 microns to 675 microns. According to various other embodiments, the CMP apparatus may be set up for polishing wafers having various thicknesses, and may include various tolerance ranges.

As such, according to the second and third exemplary embodiments of warm-up wafers wherein the warm-up wafers are preferably formed of material other than the semiconductor material used for product substrates, the warm-up wafers may be desirably formed to an original thickness of approximately 735 microns. In alternative embodiments, other original thicknesses may be used. According to the first exemplary embodiment, a silicon wafer having a thickness of 725 microns may have a mechanically resistant film having a thickness of 25 microns, formed over the wafer surface. According to another exemplary embodiment, the silicon wafer may include a thickness of approximately 650 microns, and may be covered with a mechanically resistant film having a thickness of approximately 100 microns. It should be understood to one skilled in the art, that the warm-up wafers of the present invention are not intended to be limited to the exemplary thicknesses as described above. So long as the lateral dimensions or the diameters of the generally round warm-up wafers, are essentially the same as the lateral dimensions of the generally round product wafers, the warm-up wafers may be used provided they include a thickness within the acceptable range of thickness tolerance of the CMP apparatus.

Using the warm-up wafers as described above, the warm-up procedure may be performed according to conventional methods. According a first exemplary embodiment of a warm-up procedure, an alternating sequence of polishing a set of warm-up wafers and conditioning the CMP apparatus, may be used as described above. According to a second exemplary procedure of a warm-up procedure, the conditioning process may be deferred until after a desired level of pad compression has been achieved by polishing warm-up wafers.

The time used to polish the warm-up wafers according to the method of the present invention, may vary, both when performed as one continuous polishing operation, or as a series of separate polishing operations alternating with conditioning runs. When polishing the warm-up wafers, the conditions of the warm-up polishing operation will be the same as for the polishing operation to be performed subsequent to the warm-up procedure, upon the product wafers, in the preferred embodiment. Examples of polishing conditions include slurry flow rate, slurry temperature, polishing pad rotation speed, and various other system settings. The polishing of warm-up wafers continues until a desired degree of pad compression has been achieved, signifying that this polishing pad characteristic has achieved steady state condition and that the apparatus is ready for polishing product wafers. According to various other warm-up polishing procedures, the polishing of warm-up wafers may continue until it is determined that any of other various polishing pad characteristics have attained steady state condition.

According to the first exemplary embodiment of a warm-up procedure, wherein several separate warm-up polishing operations are performed in between pad conditioning runs, the same set of warm-up wafers may be used for each of the series of separate warm-up polishing operations, or they may be replaced with new warm-up wafers. According to the second exemplary embodiment of a warm-up procedure, the same set of warm-up wafers will occupy the positions in the polishing heads during the entire continuous warm-up polishing operation.

The determination that the polishing pad characteristics have attained steady state conditions and that, therefore, the CMP apparatus is ready for polishing product wafers may be made by measuring a chosen polishing pad characteristic or monitoring a representative polishing quality. An example of such a polishing quality may be the removal rate or removal rate uniformity of a test film or of the product film which is to be polished. If the degree of pad compression is the polishing pad characteristic chosen to evaluate whether the apparatus is ready for polishing product wafers, the degree of pad compression may be measured using various measurement techniques.

An exemplary procedure for determining the amount of warm-up wafer polishing time required to achieve a desired degree of pad compression may be to polish the warm-up wafers for a given time, then to evaluate the degree of pad compression, then to repeat the process. This sequence of steps may be repeated multiple times until the desired, steady state level of pad compression has been achieved as indicated by successive pad compression measurements being substantially similar. Once a correlation is established between pad compression and warm-up wafer polishing time, the pad measurement procedure need not be repeated during subsequent warm-up procedures. Rather, the CMP apparatus can be considered ready for polishing product substrates simply after a sufficient time of polishing warm-up wafers has elapsed, since it will be known that the desired degree of pad compression has been achieved.

Methods for evaluating whether a CMP apparatus has been sufficiently warmed-up and ready for polishing product wafers based upon a desired level of pad compression having been achieved, include the following.

Mechanically measuring the resiliency of the polishing pad to determine the degree of pad compression. This may be done using various conventional methods.

Measuring the friction between the polishing pad and a unit disposed at a fixed location within the CMP apparatus, to determine the thickness, and therefore the degree of compression of the polishing pad. This may be done using various conventional methods.

Measuring the thickness of the polishing pad using conventional methods. Pad thickness is indicative of pad compression.

The above examples are intended to be illustrative only, and other conventional methods for determining the degree of pad compression, may be used. For the embodiments wherein the degree of pad compression is being measured, historical data will have been established for each type of polishing pad, regarding the desired level of pad compression required to ensure that further pad compression will not ensue, and that the CMP apparatus has therefore reached a steady state condition and may be used for polishing product wafers. As such, the warm-up polishing procedure is carried out until such a desired level of pad compression is achieved.

It should be understood that the present invention is not intended to be limited to the evaluation of the degree of polishing pad compression to determine that polishing pad characteristics have attained steady state conditions which render the CMP apparatus ready for polishing substrates. Rather, various other polishing pad characteristics may be evaluated in addition to, or instead of, the degree of polishing pad compression to determine whether a sufficient warm-up polishing time has been used. Examples of such polishing pad characteristics include temperature at the polishing pad surface, the degree of pad pore saturation with polishing slurry, the chemical boundary layer thickness formed on the polishing pad surface, the water absorptive qualities of the pad, and, in some cases, the contour formed on the pad surface. In addition, for the case of a new carrier film, the degree of carrier film compression may be measured using various techniques. A particularly favored technique is to evaluate a polishing quality such as the removal rate or removal rate uniformity of a film to be polished, rather than particular polishing pad characteristics, as above, which combine to influence polishing qualities such as the removal rate and removal rate uniformity.

For the procedure whereby the removal rate of a particular test film is used to assess whether the polishing pad characteristics have reached steady state conditions and therefore that the system is ready for polishing production wafers, the following procedure may be used. A plurality of wafers coated with the same test film will be provided. In an exemplary embodiment the test film may be the same as the product film which is to be polished after the warm-up procedure has been concluded. After the CMP apparatus has sat idle or has undergone a consumable change, the warm-up polishing procedure is performed for a given and recorded time and the removal rate of the test film is measured. After the CMP apparatus has again sat idle or had a consumable changed, the warm-up polishing procedure is repeated, again for a recorded time and the removal rate of the test film is again measured. After this sequence of events is performed multiple times, a graph such as shown in FIG. 2 may be obtained.

Figure 2:
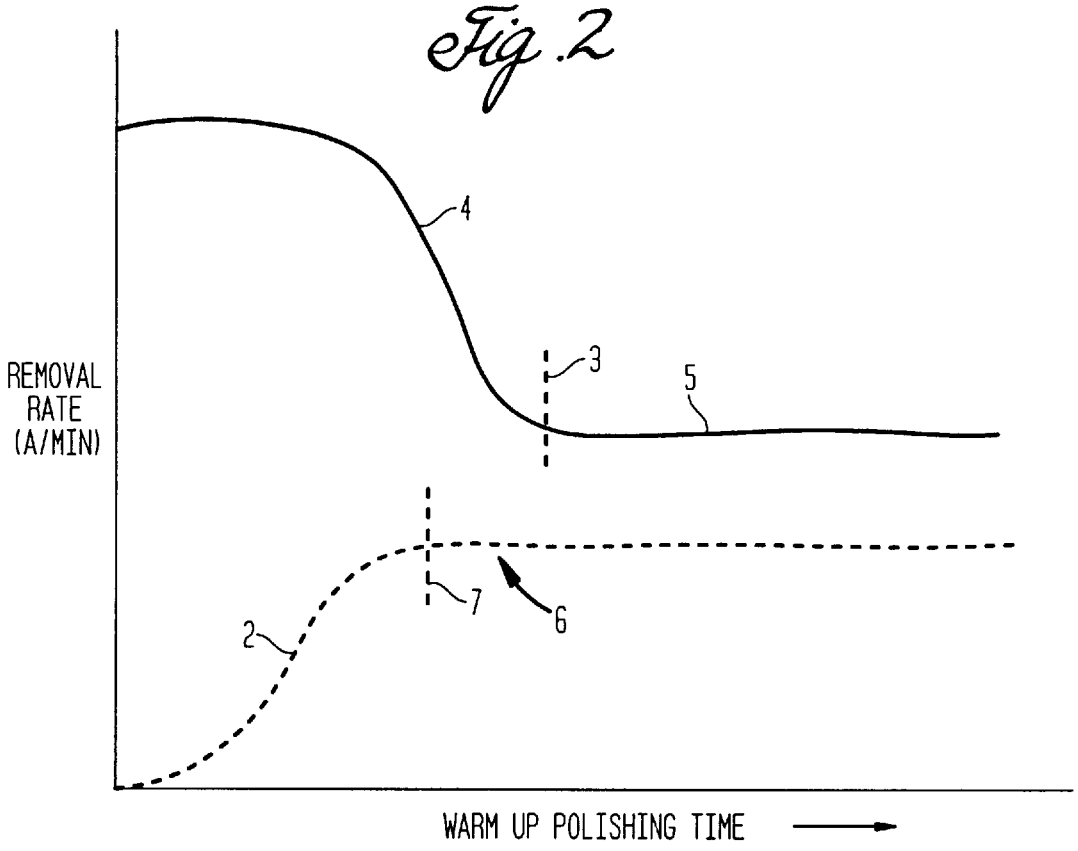
FIG. 2 is a graph showing film removal rates as a function of warm-up polishing time.

FIG. 2 shows the removal rate of exemplary test films as a function of warm-up polishing time. It can be seen that each of curves 2 and 4 attain a steady state condition after a sufficient warm-up polishing time. Depending on the film being polished, the removal rate may increase or decrease as it approaches its steady state value. In exemplary curve 4, the removal rate drops to steady state condition 5 after inflection point 3. In exemplary curve 2, the removal rate rises to steady state condition 6 after inflection point 7. A steady state condition is indicated by successive removal rate measurements being substantially the same. After the steady state condition has been achieved with respect to film removal rate, it can be seen that the polishing qualities of the CMP apparatus are not likely to fluctuate. At this point, the apparatus is ready to be used for polishing productwafers. In an alternative embodiment, the uniformity of removal rate may be measured, as above, to establish that the polishing apparatus has achieved steady state conditions. According to this embodiment, the range of removal rate may be plotted as a function of warm-up polishing time.

It should be understood that, for each warm-up polishing procedure using various warm-up wafers according to the present invention, once a correlation has been established indicating how much warm-up polishing time is required to bring the polishing pad characteristics to steady state conditions and thereby render the CMP apparatus ready for polishing product wafers, the evaluation process (measuring pad compression or film removal rates, for example) need not be repeated during subsequent warm-up procedures. Rather, after the established warm-up polishing time has been elapsed, the CMP system may be used to polish product substrates. This is true for each of the warm-up wafer embodiments and for each of the warm-up procedure embodiments.

The warm-up wafers of the present invention which include a warm-up polishing surface including a mechanically-resistant material such as described in embodiments 1 and 3, provides the advantage that, during the warm-up polishing operation, the thickness of the mechanically-resistant material is not significantly diminished. As such, the warm-up wafers as provided in exemplary embodiments 1 and 3, may be used virtually indefinitely.

While the thickness of the warm-up wafers provided according to the second exemplary embodiment, does diminish during each polishing operation, the warm-up wafers having a surface of a material having similar polishing characteristics, can be used repeatedly, provided the thickness of the warm-up wafer lies within the tolerance levels of the polishing apparatus. According to an exemplary embodiment wherein a CMP apparatus has a thickness tolerance of 100 microns, a warm-up wafer formed according to the second exemplary embodiment may include an original thickness of 750 microns and may be used continuously as a polishing warm-up wafer until its thickness has decreased to 650 microns. This thickness range of 100 microns provides for multiple uses as a warm-up wafer according to the present invention. Furthermore, the composition of the warm-up wafer formed according to the second exemplary embodiment, is the same throughout the depth of the substrate. As above, the transition from polishing one film to another during a continuous polishing operation changes the nature of the wafer/pad interface and can disrupt the steady state conditions of the pad. This undesirable transition state is thereby avoided by using the warm-up wafer formed according to the second exemplary embodiment.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principals of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents such as equivalents developed in the future, i.e., any elements developed that perform the same function, regardless of structure. The scope of the present invention, therefore, is not intended to be limited to the exemplary embodiments shown and described herein. Rather, the scope and spirit of the present invention is embodied by the appended claims.

What is claimed:

1. A method for preparing a chemical mechanical polishing (CMP) apparatus for polishing a product substrate, comprising the steps of:

providing a plurality of warm-up substrates formed of a first material, and a CMP apparatus having a plurality of polishing heads;

positioning a warm-up substrate of the plurality of warm-up substrates within each polishing head of the CMP apparatus;

polishing the positioned warm-up substrates using a polishing pad within the CMP apparatus until a steady-state polishing condition is achieved; and thereafter, polishing a product film formed over the product substrate, the product substrate formed of a semiconductor material being different from the first material, wherein each warm-up substrate of the plurality of warm-up substrates is reusable.

2. The method as in claim 1, wherein the step of polishing the positioned warm-up substrates comprises polishing until a prescribed compression of the polishing pad is achieved.

3. The method as in claim 2, in which the step of polishing the positioned warm-up substrates includes determining when the prescribed compression of the polishing pad has been achieved based upon a correlation established between polishing pad compression and warm-up polishing time.

4. The method as in claim 2, in which the step of polishing the positioned warm-up substrates includes determining when the prescribed compression of the polishing pad has been achieved by monitoring a removal rate of the product film wherein the product film is further formed on a plurality of test substrates usable for the monitoring.

5. The method as in claim 2, in which the step of polishing the positioned warm-up substrates includes determining when the prescribed compression of the polishing pad has been achieved by mechanically measuring compression of the polishing pad.

6. The method as in claim 5, in which the step of polishing the positioned warm-up substrates includes mechanically measuring compression of the polishing pad by measuring a resiliency of the polishing pad.

7. The method as in claim 5, in which the step of polishing the positioned warm-up substrates includes mechanically measuring compression of the polishing pad by measuring polishing pad thickness.

8. The method as in claim 5, in which the step of polishing the positioned warm-up substrates includes measuring friction between a surface of the polishing pad and a further member.

9. The method as in claim 1, wherein the step of polishing the positioned warm-up substrates comprises polishing until at least some polishing pad characteristics have reached steady state conditions.

10. The method as in claim 1, wherein the first material has the same or substantially the same film removal characteristics as the product film.

11. The method as in claim 10, where in the first material comprises titanium and the product film comprises aluminum.

12. The method as in claim 10, wherein the first material and the product film comprise different materials.

13. The method as in claim 1, wherein the first material is a mechanically resistant material.

14. The method as in claim 13, wherein the first material comprises one of quartz, silicon carbide and glass.

15. The method as in claim 1, in which the step of polishing the positioned warm-up substrates includes a single continuous warm-up polishing operation.

16. The method as in claim 1, in which the step of polishing the positioned warm-up substrates includes a series of separate warm-up polishing operations.

17. The method as in claim 16, in which the step of polishing the positioned warm-up substrates further comprises conditioning the polishing pad after at least one separate warm-up polishing operation of the series of separate warm-up polishing operations.

18. The method as in claim 16, in which the step of polishing the positioned warm-up substrates further comprises determining a removal rate of a test film formed on a test substrate after each separate warm-up polishing operation of the series of separate warm-up polishing operations, and includes continuing the polishing until successive removal rates are substantially the same.

19. The method as in claim 1, wherein the semiconductor material comprises silicon.

20. The method as in claim 1, wherein polishing the positioned warm-up substrates and polishing the product film each include the same polishing conditions.

21. A method for preparing a chemical mechanical polishing (CMP) apparatus for polishing a product substrate, comprising the steps of:

providing a plurality of warm-up substrates, each having a warm-up surface formed of one of silicon carbide, glass, and quartz;

providing a CMP apparatus having a plurality of polishing heads;

positioning a warm-up substrate of the plurality of warm-up substrates within each polishing head of the CMP apparatus;

polishing warm-up surfaces of each positioned warm-up substrate using a polishing pad within the CMP apparatus, until a prescribed compression of the polishing pad is achieved; and polishing a product film formed on the product substrate formed of a semiconductor material, wherein each warm-up substrate of the plurality of warm-up substrates is reusable and the product film is formed of a material other than silicon carbide, glass, and quartz.

* * * * *